US008367973B2

(12) United States Patent
Suzuki et al.

(10) Patent No.: US 8,367,973 B2
(45) Date of Patent: Feb. 5, 2013

(54) HEATER WITH TEMPERATURE DETECTING DEVICE AND BATTERY STRUCTURE WITH THE HEATER

(75) Inventors: Masahiko Suzuki, Hoi-gun (JP); Jun Okuda, Aichi-gun (JP); Yuji Torii, Toyohashi (JP); Yukie Uemura, Toyohashi (JP); Kunio Kanamaru, Okazaki (JP)

(73) Assignee: Panasonic EV Energy Co., Ltd., Kosai-shi (JP)

( * ) Notice: Subject to any disclaimer, the term of this patent is extended or adjusted under 35 U.S.C. 154(b) by 877 days.

(21) Appl. No.: 11/907,482

(22) Filed: Oct. 12, 2007

(65) Prior Publication Data

US 2008/0093353 A1 Apr. 24, 2008

(30) Foreign Application Priority Data

Oct. 19, 2006 (JP) ..... 2006-285124

(51) Int. Cl.
*H05B 1/00* (2006.01)

(52) U.S. Cl. ..... 219/209; 219/250; 219/521; 219/538; 219/544

(58) Field of Classification Search ..... 219/209, 219/511, 544, 548, 528, 549, 543, 211, 212, 219/213, 520, 525, 527, 529, 538, 541, 545, 219/494, 510, 521; 26/611; 156/179; 29/611
See application file for complete search history.

(56) References Cited

U.S. PATENT DOCUMENTS 1,869,629 A * 8/1932 Stranszky ..... 219/535
2,024,153 A * 12/1935 Eskin ..... 219/494
2,039,641 A * 5/1936 Fichtner ..... 219/510
2,349,612 A * 5/1944 Campbell ..... 219/486
2,458,184 A * 1/1949 Marick ..... 219/536
2,626,971 A * 1/1953 Mansoff ..... 429/120
4,358,668 A * 11/1982 McMullan et al. ..... 219/528
4,762,978 A * 8/1988 Tanis ..... 219/209
4,860,434 A * 8/1989 Louison et al. ..... 29/611

(Continued)

FOREIGN PATENT DOCUMENTS

JP 61-292876 A 12/1986
JP 03-266387 A 11/1991

(Continued)

OTHER PUBLICATIONS

Aug. 23, 2011 Japanese Office Action issued in Japanese Patent Application No. 2006-285124 (with translation).

*Primary Examiner* — Henry Yuen
*Assistant Examiner* — John Wasaff
(74) *Attorney, Agent, or Firm* — Oliff & Berridge, PLC

(57) ABSTRACT

A heater with temperature detecting device, arranged to accurately detect the temperature of a laminated sheet heater over long periods, and a battery structure including the same. A first embodiment includes a laminated sheet heater and a temperature sensor having a temperature measuring portion. The laminated sheet heater includes first and second insulating resin films, a heater element, a first metal sheet, and a second metal sheet and includes a heater metallic section in which, any one of only the first metal sheet and only a combination of the first metal sheet and the second metal sheet is arranged in a lamination layering direction of the laminated sheet heater. The temperature sensor is fastened to the heater metallic section with a flat rivet and fixed to an outer surface of the first metal sheet with the temperature measuring portion in contact with the first metal sheet.

9 Claims, 10 Drawing Sheets

U.S. PATENT DOCUMENTS

| | | | | |
|---|---|---|---|---|
| 4,952,783 | A * | 8/1990 | Aufderheide et al. | 219/528 |
| 5,542,489 | A * | 8/1996 | Allison et al. | 180/68.5 |
| 6,415,104 | B1 * | 7/2002 | Fitts et al. | 392/503 |
| 2004/0195234 | A1 * | 10/2004 | Kaesler | 219/548 |
| 2006/0214412 | A1 * | 9/2006 | Schmaranzer et al. | 280/781 |

FOREIGN PATENT DOCUMENTS

| | | | |
|---|---|---|---|
| JP | 09-190840 | A | 7/1997 |
| JP | A-2004-355882 | | 12/2004 |
| JP | A-2004-356087 | | 12/2004 |

* cited by examiner

HEATER WITH TEMPERATURE DETECTING DEVICE AND BATTERY STRUCTURE WITH THE HEATER

BACKGROUND OF THE INVENTION

1. Field of the Invention

The present invention relates to a heater including a laminated sheet heater and a temperature detecting device, and to a battery structure with this heater with temperature detecting device.

2. Description of Related Art

For fixing a temperature detecting device (a temperature sensor or the like) to the surface of a heater to detect the temperature of the heater, adhesive agents, adhesive tapes, or the like are often used as a fixing means.

Jpn. unexamined patent publication No. 2004-356087 discloses a heater having a substrate, a heating element placed on the substrate, and a fixing material placed over the substrate in such a manner as to cover the heating element. This publication discloses in the first embodiment the heater that includes a temperature detecting device embedded therein with a fixing material as well as the heating element.

Thinner heaters have been desired in recent years, increasing demands for a laminated sheet heater configured such that a heating element made of metal foil in a predetermined pattern is sandwiched between two insulating resin films (polyimide film or the like) (see Jpn. unexamined patent publication No. 2004-355882).

This laminated sheet heater has been used for example in heating a battery in cold environments to enhance output characteristics of the battery. To be concrete, there has been proposed a technique that a laminated sheet heater is placed inside a bottom of a battery for vehicle to heat the battery using a household power source (see Jpn. unexamined utility model publication No. 60(1985)-192367).

To this laminated sheet heater, there is also a demand to attach a temperature detecting device capable of detecting the temperature of the heater. However, this heater is very small in thickness and could not internally hold the temperature detecting device as in the above publication '087.

The technique of fixing the temperature detecting device with adhesive agents or adhesive tapes is apt to be influenced by degradation of adhesive power caused by heat of the heater and aged deterioration of the adhesive agent. This may cause a problem that a temperature measuring portion of the temperature detecting device could not be held stably in fixedly contact with the heater. Thus, the temperature of the heater could not be measured accurately in the long term.

Under the above circumstances, the inventors of the present invention have come up with a configuration that the temperature detecting device is placed in contact with the surface of the laminated sheet heater and fixed thereto with use of a mechanical fastening device such as a metal fixing member (a rivet or the like). However, when the temperature detecting device is fixed to the laminated heater including two insulating resin films with use of the mechanical fastening device, the two insulating resin films are likely to be deformed or distorted by the fastening power of the mechanical fastening device. This may cause the surface of the laminated heater that makes contact with the temperature detecting device to be deformed or distorted, thus generating a gap between the temperature measuring portion of the temperature detecting device and the surface of the laminated heater. Accordingly, the temperature detecting device may not accurately detect the temperature of the laminated heater.

Furthermore, after fastening, creep of the insulation resin film (i.e., a phenomenon in which deformation or distortion gradually increases over time) may affect a fastened portion, gradually decreasing the thickness of the fastened portion of the insulation resin film. As a result, the fastening power will progressively go down, so that a gap is likely to be formed between the temperature measuring portion of the temperature detecting device and the surface of the laminated heater. Consequently, the temperature detecting device may not detect the temperature of the laminated heater accurately in the long term.

SUMMARY OF THE INVENTION

The present invention has been made in view of the above circumstances and has an object to provide a heater with temperature detecting device, arranged to accurately detect the temperature of a laminated sheet heater by a temperature detecting device over long periods, and to provide a battery structure provided with the heater with temperature detecting device.

According to one aspect, the present invention provides, a heater with temperature detecting device, comprising: a laminated sheet heater including: a first insulating resin film; a second insulating resin film; a heater element made of metal foil in one of a strip-shaped predetermined pattern and a sheet shape, the heater element being placed between the first insulating resin film and the second insulating resin film, and at least one of a first metal sheet laminated on a surface of the first insulating resin film opposite the heater element and a second metal sheet laminated on a surface of the second insulating resin film opposite the heater element; and a temperature detecting device including a temperature measuring portion; wherein the laminated heater includes a heater metallic section in which, of the first insulating resin film, the second insulating resin film, the heater element, the first metal sheet, and the second metal sheet, any one of only the first metal sheet and only a combination of the first metal sheet and the second metal sheet is arranged in a lamination direction of the laminated heater, the temperature detecting device is fastened to the heater metallic section of the laminated heater with mechanical fastening means so that the temperature detecting device is fixed to an outer surface of the first metal sheet with at least the temperature measuring portion of the temperature detecting device held in contact with the first metal sheet.

In the heater with temperature detecting device according to the present invention, the laminated heater constituted of the heater element, first insulating resin film, second insulating resin film, first metal sheet, and second metal sheet includes the heater metallic section in which, of the first insulating resin film, the second insulating resin film, the heater element, the first metal sheet, and the second metal sheet, any one of only the first metal sheet and only a combination of the first metal sheet and the second metal sheet is arranged in a lamination direction of the laminated heater. In other words, in the heater metallic section, the first metal sheet or the combination of the first metal sheet and the second metal sheet is arranged without the first insulating resin film, the second insulating resin film, and the heater element in the lamination direction of the laminated heater. The temperature detecting device is fixed to the heater metallic section of the laminated heater with use of the mechanical fastening means. In other words, the temperature detecting device and the heater metallic section are fixed to each other with the mechanical fastening means without the heater element, first insulating resin film and second insulating resin film.

In this way, when the temperature detecting device is fixed to the heater metallic section without the first and second insulating resin films, the first and second insulating resin films will not be influenced by the fastening power of the mechanical fastening means and thus not deformed or distorted. The heater metallic section is more rigid than the insulating resin film and therefore unlikely to be distorted or deformed by the fastening power of the mechanical fastening means. This makes it possible to prevent generation of a gap between the temperature measuring portion of the temperature detecting device and the outer surface of the first metal sheet. Consequently, the temperature detecting device can be fixed to the first metal sheet while at least the temperature measuring portion of the temperature detecting device is held in contact with the outer surface of the first metal sheet.

The first and second insulating resin films are not influenced by the fastening power of the mechanical fastening means and thus are unlikely to creep (a phenomenon in which deformation or distortion gradually increases over time). The heater metallic section is originally hard to creep. Thus, the temperature measuring portion of the temperature detecting device can be stably held in contact with the first metal sheet for long periods.

This allows the heater with temperature detecting device according to the present invention to accurately detect the temperature of the laminated heater by the temperature detecting device over a long period of time.

The mechanical fastening means may include a metal fixing member (a flat rivet, a blind rivet, a metal eyelet, etc.), a bolt, a nut, and others.

The technique of fastening the temperature detecting device to the heater metallic section with the mechanical fastening means may include a technique of fastening the temperature detecting device and the heater metallic section in pressure contact with each other with the mechanical fastening means by using the through holes of the heater metallic section and the temperature detecting device. To be concrete, in an example using a flat rivet as the mechanical fastening means, the temperature detecting device is disposed on the surface of the first metal sheet in such a manner as to coaxially align the through hole of the heater metallic section with the through hole of the temperature detecting device, and then the shaft of the flat rivet is inserted through the through holes of the heater metallic section and the temperature detecting device. The flat rivet is then plastically deformed by fixing an end of the shaft, bringing the temperature detecting device and the heater metallic section pressure into contact with each other in a direction of the rivet shaft. Thus, the temperature detecting device is fastened to the heater metallic section.

The temperature detecting device may include a temperature sensor having a temperature detecting element (a thermistor or a thermocouple) and a holder that holds the temperature detecting element. The heater with temperature detecting device according to the present invention, which includes the temperature sensor as the temperature detecting device, can detect the temperature of the laminated heater accurately over long periods. In this temperature sensor, the temperature detecting element or a set of the temperature detecting element and the holder (a holding portion of the holder that holds the temperature detecting element) correspond to the temperature measuring portion.

For the temperature detecting device, an excessive-temperature-rise preventing device such as a thermal fuse and a PTC thermistor may be used. In the case where the excessive-temperature-rising preventing device is used, the heater with temperature detecting device according to the present invention can accurately detect the temperature of the laminated heater through the excessive-temperature-rise preventing device. If the temperature of the laminated heater excessively rises, the excessive-temperature-rise preventing element can quickly interrupt (or restrain) energization of the heater. Thus, the laminated heater can be prevented from excessively rising in temperature.

In the aforementioned heater with temperature detecting device, preferably, the mechanical fastening means is a metal fixing member for fastening the temperature detecting device to the heater metallic section.

In the aforementioned heater with temperature detecting device, preferably, the laminated sheet heater includes both the first metal sheet and the second metal sheet, and the heater metallic section includes, of the first metal sheet and the second metal sheet, only the first metal sheet in the lamination direction of the laminated heater.

In the aforementioned heater with temperature detecting device, preferably, the temperature detecting device includes a fastened portion secured to the heater metallic section with the mechanical fastening means, the fastened portion arranged to have strength enough to keep its shape against fastening power of the mechanical fastening means.

In the aforementioned heater with temperature detecting device, preferably, the temperature detecting device is placed in a position surrounded by the heater element in plan view of the laminated heater.

According to another aspect, the present invention provides a battery structure with heater, comprising: a battery structure containing a power generating element and having a surface to be heated; and a heater fixed to the battery structure and arranged to heat the surface to be heated to thereby heat the power generating element; wherein the heater is the aforementioned heater with temperature detecting device, one of the outer surface of the first metal sheet and an outer surface of the second metal sheet is held in contact with at least part of the surface of the battery structure to be heated.

The battery structure with heater according to the present invention includes any one of the aforementioned heaters with temperature detecting device and is further configured such that the outer surface of the first or second metal sheet is placed in contact with at least part of the surface of the battery structure to be heated. Accordingly, the battery structure can be heated by the heater with temperature detecting device. In particular, the outer surface of the metal sheet can have a smaller variation in temperature distribution than the surface of the insulating resin film. When the battery structure is heated in a state where the outer surface of the first or second metal sheet is in contact with the heated surface of the battery structure, accordingly, uneven heating of the heated surface can be reduced. It is therefore possible to minimize uneven heating of the power generating element of the battery structure.

Further, the aforementioned heater with temperature detecting device can accurately detect the temperature of the heater by the temperature detecting device for long periods as mentioned above. When the temperature of the heater is controlled (e.g., ON-OFF control) by use of the temperature detecting device, the battery structure can be heated appropriately over long periods.

The battery structure is for example a cell including a single power generating element accommodated in a battery case, a battery module provided with a battery case having a plurality of compartments integrally formed and power generating elements individually accommodated in the compartments, and a battery pack including a plurality of cells or battery modules, connected in series or parallel and held in a housing or holding frame.

The power generating element is accommodated in a battery case for providing a battery function and is formed of for example a positive electrode plate, a negative electrode plate, a separator, and electrolyte.

An example of the surface to be heated (referred to as a "heated surface") is the outer surface (the entire or part of the outer surface) of the battery structure such as a unit cell and a battery pack. Of the heated surface, a portion that makes contact with the outer surface of the first metal sheet or the second metal sheet will be a portion to be heated (referred to as a "heated portion"). When the heated surface is a partly-recessed surface (for example, a recess made by press molding for reinforcement). A portion of the partly-recessed surface other than the recess is flat. When the flat portion of the heated surface excepting the recess is in contact with the outer surface of the first or second metal sheet, a part of the heated (i.e., the flat portion) surface will be the heated portion. At that time, part of the outer surface of the first or second metal sheet is in contact with the heated portion. On the other hand, when the entire heated surface is flat and in contact with the outer surface of the first or second metal sheet, the entire heated surface will be the heated portion.

In the aforementioned battery structure with heater, preferably, the surface of the battery structure to be heated includes: a flat portion to be heated; and a recessed portion protruding into inside of the battery structure; the heater with temperature detecting device is placed so that the temperature detecting device is received in the recessed portion of the surface to be heated and the outer surface of the first metal sheet is held in contact with the surface to be heated.

The battery structure with heater is preferably arranged such that the aforementioned battery structure includes the heater with temperature detecting device attached to the battery structure in such a manner as to be detachable from the battery structure.

DETAILED DESCRIPTION OF THE PREFERRED EMBODIMENTS

A detailed description of a preferred embodiment of a battery structure with heater (hereinafter, referred to as a "heater-equipped battery structure") 10 according to the present invention will now be given referring to the accompanying drawings.

Figure 1:
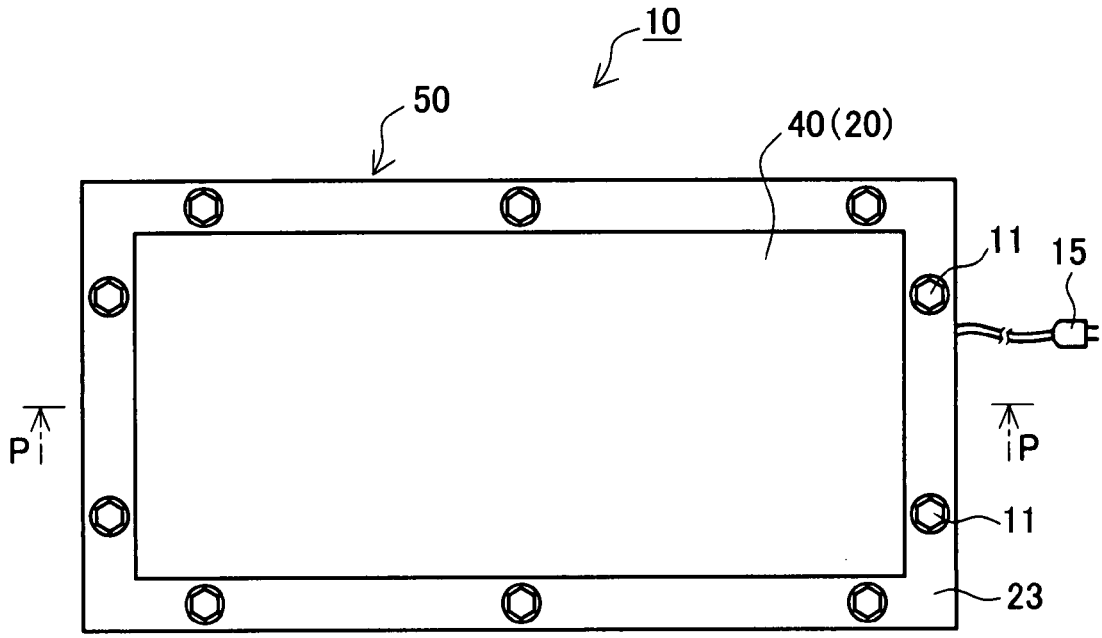
FIG. 1 is a top view of a battery structure with heater of a preferred embodiment.
Figure 2:
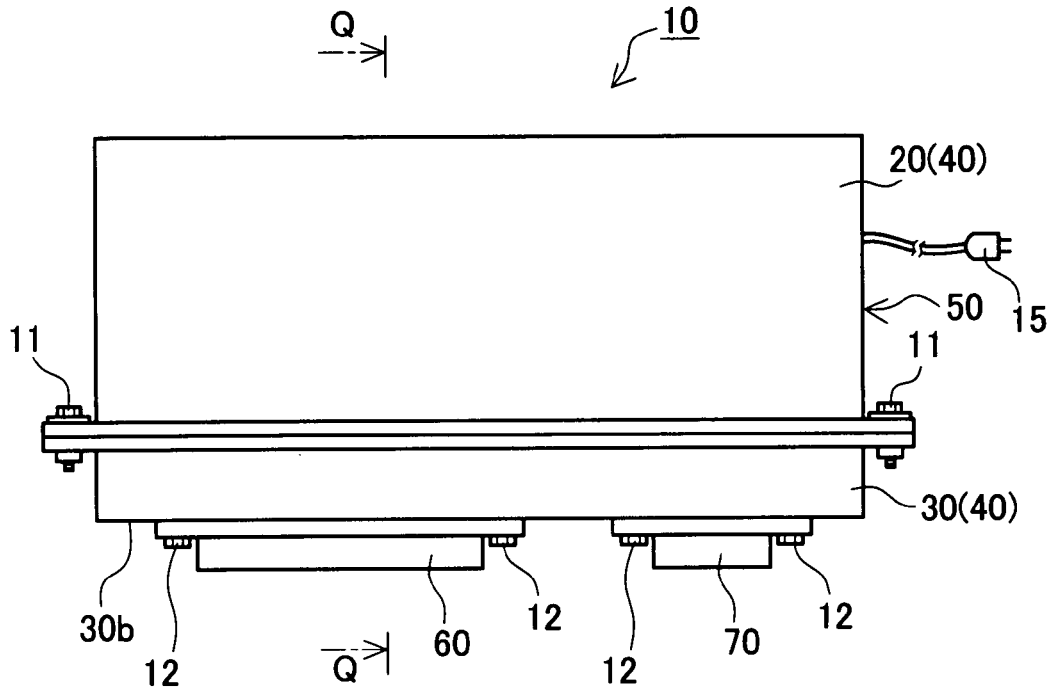
FIG. 2 is a side view of the battery structure with heater of the embodiment.

The heater-equipped battery structure 10 includes a battery pack 50, a first heater unit 60, and a second heater unit 70 as shown in FIGS. 1 and 2.

Figure 3:
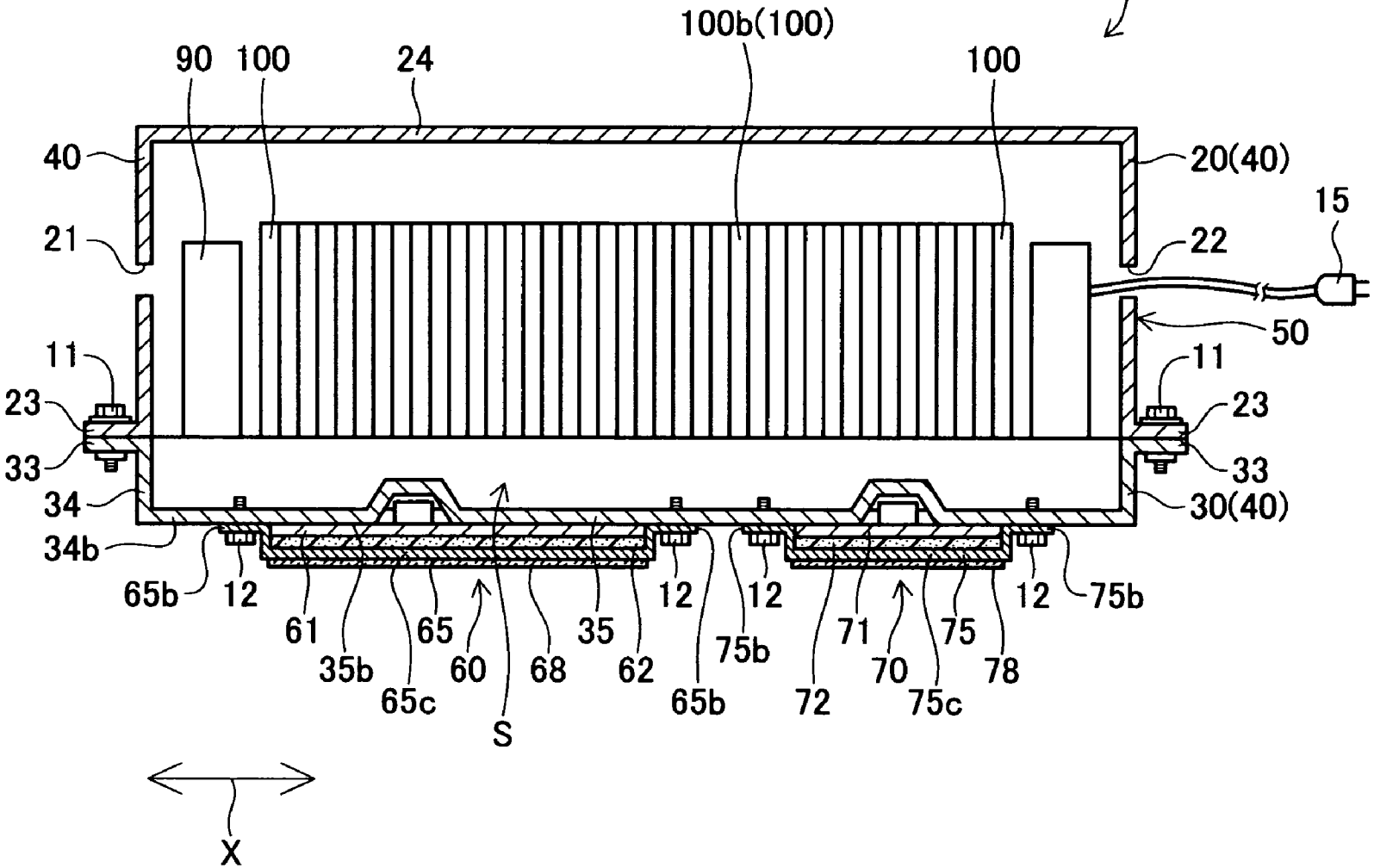
FIG. 3 is a sectional view of the battery structure with heater, taken along a line P-P in FIG. 1.

The battery pack 50 includes a housing case 40 constituted of a first housing member 20 and a second housing member 30, and a plurality of secondary batteries 100 (forty batteries in the present embodiment) housed in the housing case 40, as shown in FIG. 3. In the present embodiment, the battery pack 50 corresponds to a battery structure.

Figure 4:
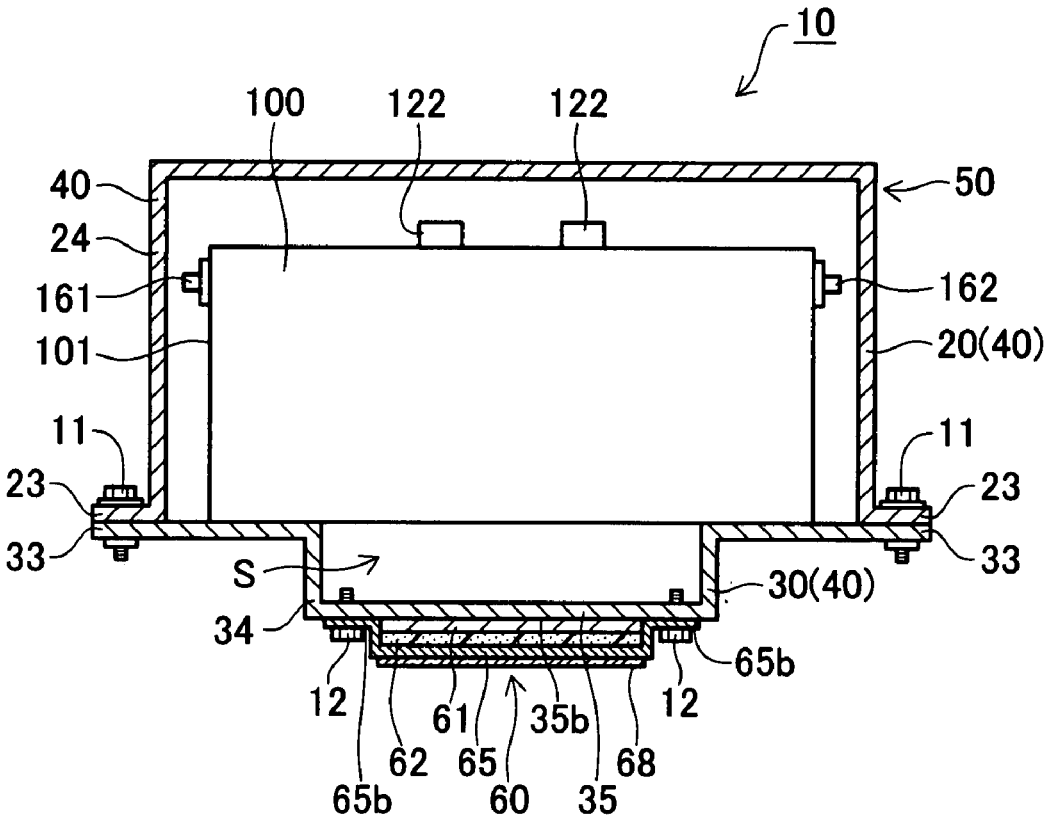
FIG. 4 is a sectional view of the battery structure with heater, taken along a line Q-Q in FIG. 2.
Figure 5:
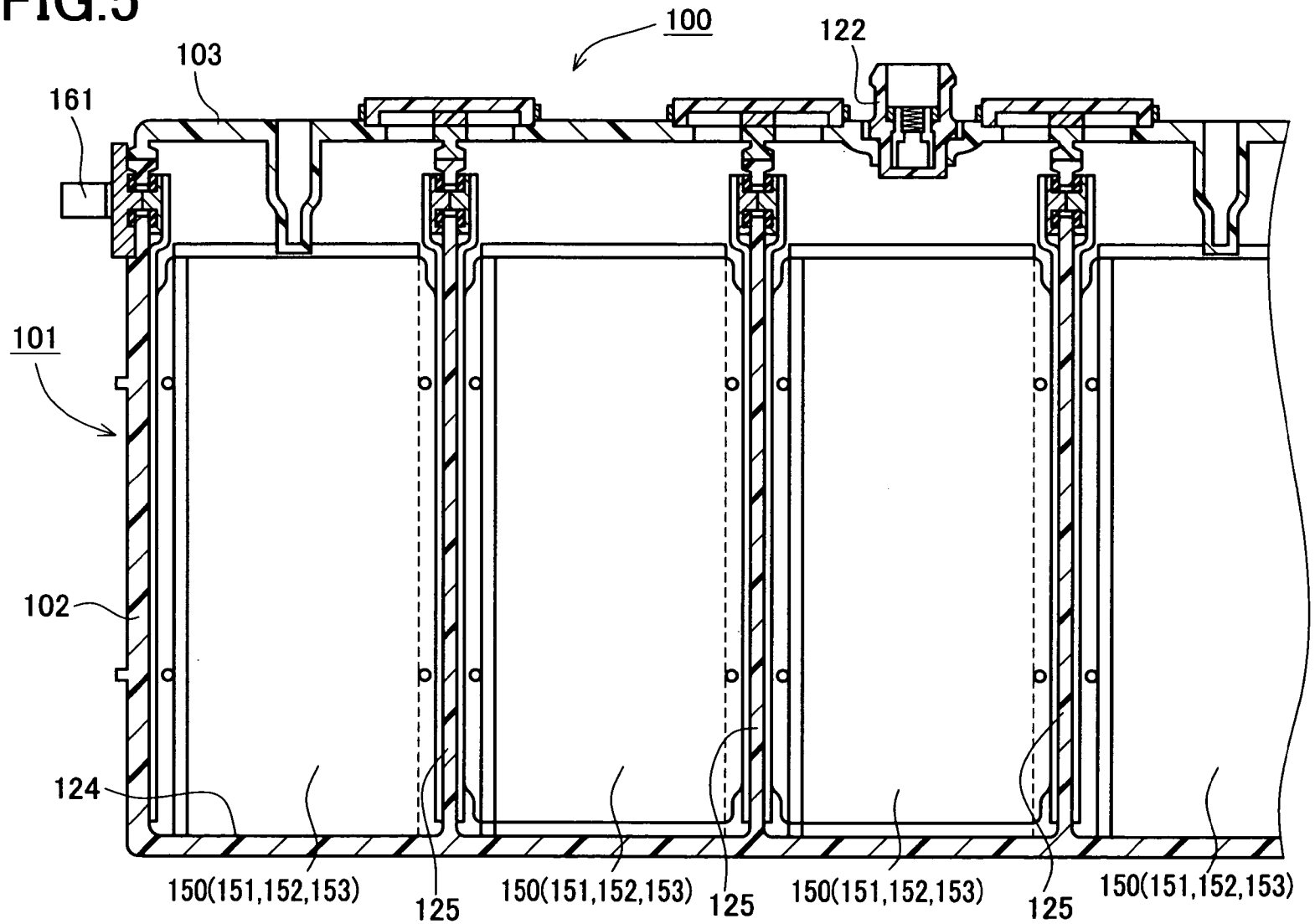
FIG. 5 is a sectional view of a secondary battery of the present embodiment.

Each secondary battery 100 is a nickel-metal hydride storage sealed battery provided with a battery case 101, a positive terminal 161 and a negative terminal 162, as shown in FIG. 4. The battery case 101 has a resin case body 102 of a nearly rectangular box shape and a resin cover 103 of a nearly rectangular plate shape, as shown in FIG. 5. The case body 102 is internally divided into six compartments 124 by partition walls 125. Each compartment 124 accommodates an electrode plate group 150 (positive plates 151, negative plates 152, and separators 153) and an electrolyte (not shown). The electrode plate groups 150 individually accommodated in the compartments 124 are connected in series to one another. Thus, the secondary battery 100 of the present embodiment constitutes a battery module including six cells connected in series.

The electrode plate group 150 and the electrolyte (not shown) correspond to a power generating element. The cover 103 is provided with a safety valve 122.

In the present embodiment, as shown in FIG. 3, forty secondary batteries 100 configured as above are arranged in a row in a row direction X (a lateral direction in FIG. 3) and connected in series to one another.

The first housing member 20 is made of metal in a rectangular recessed form which includes a housing part 24 housing the secondary batteries 100 and a rectangular annular flange 23 surrounding an open end of the housing part 24. The second housing member 30 includes a rectangular recessed metal part 34 and a rectangular annular flange 33 surrounding an open end of the recessed part 34.

On the flange 33 of the second housing member 30, the secondary batteries 100 are fixedly placed (see FIGS. 3 and 4). Further, the first housing member 20 is fixed to the second housing member 30 with mounting bolts 11 so that the flange 23 is placed in contact with the flange 33 of the second housing member 30, containing the secondary batteries 100 in the housing part 24.

The thus configured battery pack 50 includes, as part of a bottom wall **34*b* of the recessed part 34 of the second housing member 30, a part 35 located in spaced relation to the secondary batteries 100, leaving a space S therefrom. This part 35 is hereinafter referred to as a "spaced part". In the present embodiment, the outer surface of the spaced part 35 will be a surface to be heated (hereinafter, referred to as a "heated surface") 35*b*** as mentioned later.

Figure 6:
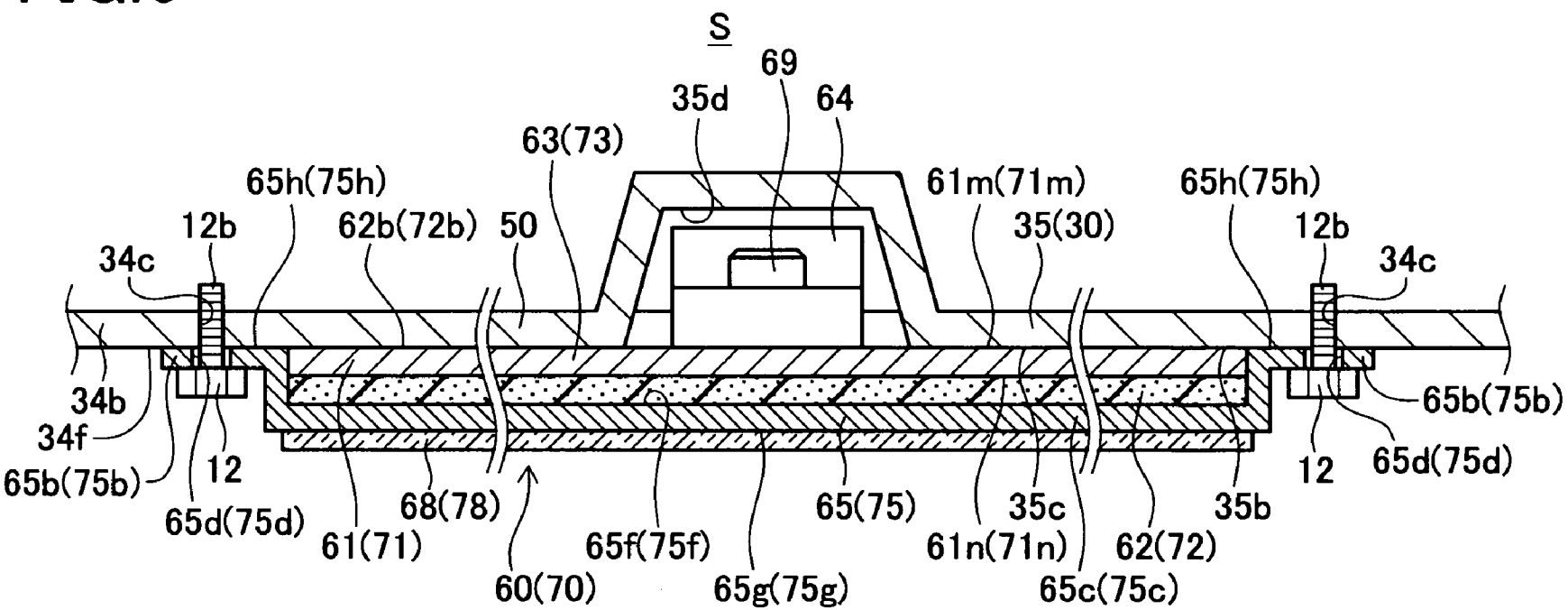
FIG. 6 is a perspective sectional view of a first heater (a second heater)

As shown in FIG. 6, the first heater unit 60 includes a first heater 63 with temperature detecting device (hereinafter, simply referred to as a "first heater"), a first sheet 62, a first holder 65 that holds them, and a heat insulating member 68. The first heater 63 is bonded to a first surface (an upper surface in FIG. 6) 62*b* of the first sheet 62 which is bonded to a holding surface 65*f* of the first holder 65. The heat insulating member 68 is bonded to a surface 65*g* (a lower surface in FIG. 6) of the holder 65 opposite the holding surface 65*f*. Thus, the first heater unit 60 is constituted of the first heater 63, the first sheet 62, the first holder 65, and the heat insulating member 68 which are integrally bonded to one another.

Figure 7:
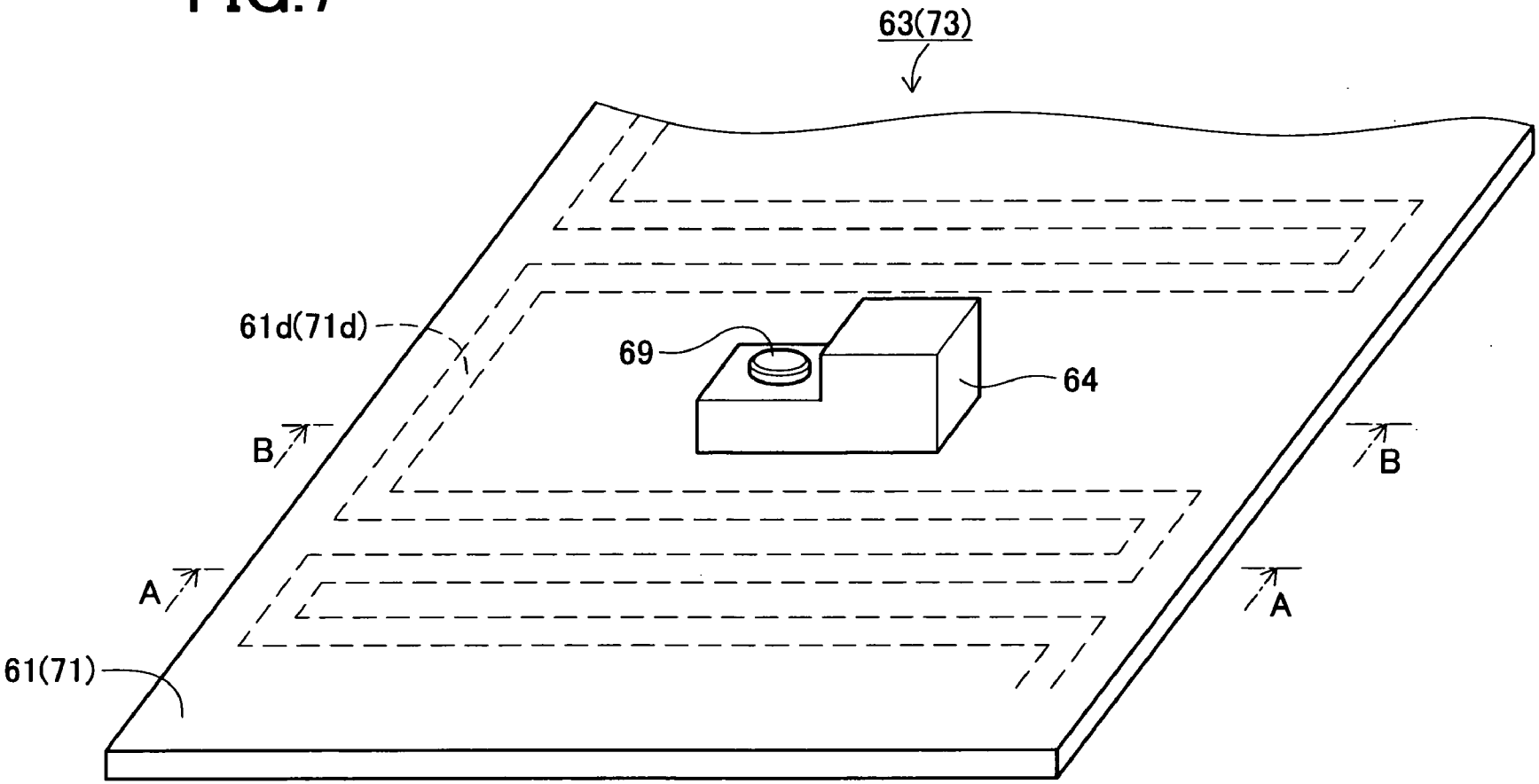
FIG. 7 is a perspective view of a first heater with temperature detecting device (a second heater with temperature detecting device)

The first heater 63 includes a first laminated sheet heater 61 and a temperature sensor 64 (corresponding to a temperature detecting device) as shown in FIG. 7.

Figure 8:
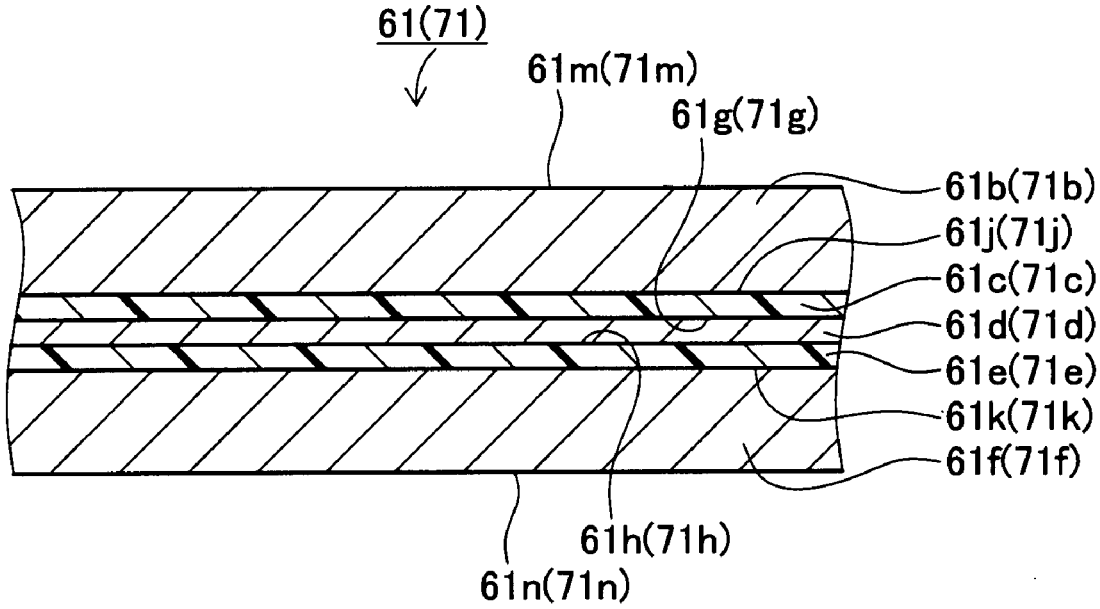
FIG. 8 is a sectional view of a first laminated heater (a second laminated heater), taken along a line A-A in FIG. 7.

The first laminated heater 61 is a sheet heater of a laminated structure, as shown in FIG. 8, including a first insulating resin film 61*c*, a second insulating resin film 61*e*, a heater element 61*d* placed between an inner surface 61*g* (a lower surface in FIG. 8) of the first insulating resin film 61*c* and an inner surface 61*h* (an upper surface in FIG. 8) of the second insulating resin film 61*e*, a first metal sheet 61*b* laminated on an outer surface 61*j* (an upper surface in FIG. 8) of the first insulating resin film 61*c* opposite the heater element 61*d*, and a second metal sheet 61*f* laminated on an outer surface 61*k* (a lower surface in FIG. 8) of the second insulating resin film 61*e* opposite the heater element 61*d*.

The heater element 61*d* is made of a nickel-chromium alloy foil and formed in a predetermined pattern extending along a plane, for example, in a strip-shaped serpentine pattern as shown by a dotted line in FIG. 7. The first and second insulating resin layers 61*c* and 61*e* are formed of polyimide films. The first and second metal sheets 61*b* and 61*f* are formed of aluminum plates.

Figure 9:
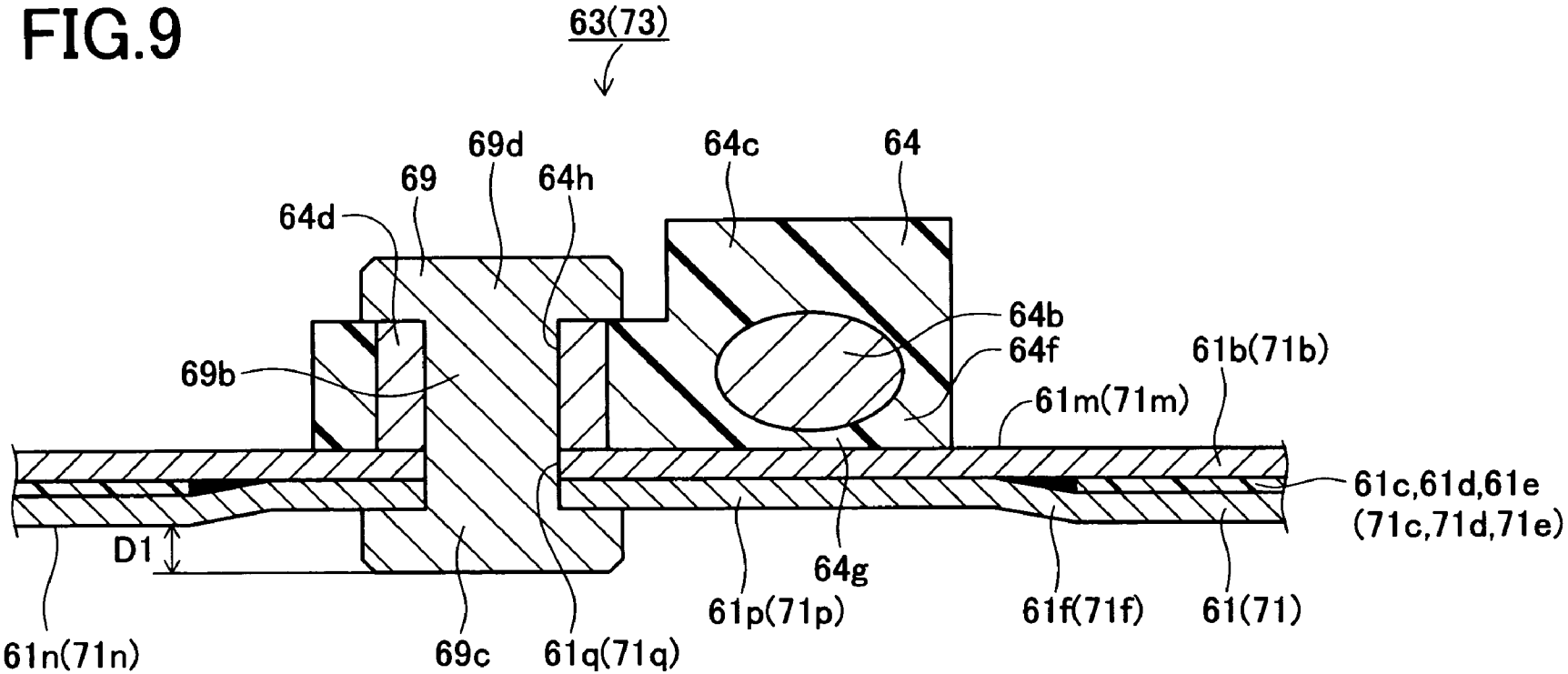
FIG. 9 is a sectional view of a mounting structure of a temperature sensor of the first heater with temperature detecting device (the second heater with temperature detecting device), taken along a line B-B in FIG. 7.

The temperature sensor 64 includes a temperature detecting element 64*b* (a thermistor in the present embodiment) and a retainer 64*c* that retains the temperature detecting element 64*b* as shown in FIG. 9. The retainer 64*c* includes a retaining portion 64*f* retaining the temperature detecting element 64*b* and a cylindrical metal part 64*d* to be fastened (hereinafter, referred to as a "fastened part"). This temperature sensor 64 is fixedly coupled, at the fastened part 64*d*, to the first laminated heater 61 with a flat rivet 69 (corresponding to a metal fixing member and a mechanical fastening means) so that a temperature measuring portion 64*g* is in contact with an outer surface 61*m* of the first metal sheet 61*b*.

In the temperature sensor 64, the temperature detecting element 64*b* and the element-retaining portion 64*f* constitute the temperature measuring portion 64*g*.

Meanwhile, when the temperature sensor 64 is fastened to a portion of the first laminated heater 61 in which the first and second insulating resin films 61*c* and 61*e* are laminated with a mechanical fastening device such as a metal fixing member, the first and second insulating resin films 61*c* and 61*e* are apt to be deformed or distorted by the fastening power of the mechanical fastening device, causing generation of a gap between the temperature measuring portion 64*g* of the temperature sensor 64 and the outer surface 61*m* of the first metal sheet 61*b*. In such cases, accordingly, the temperature sensor 64 could not detect accurately the temperature of the first laminated heater 61. Furthermore, even after fastening, creep of the first and second insulating resin films 61*c* and 61*e* may affect the fastened portion, gradually decreasing the thickness of the fastened portions of the first and second insulating resin films 61*c* and 61*e*, thereby causing the fastening power to progressively go down. Consequently, the temperature sensor 64 may not accurately detect the temperature of the first laminated heater 61 in the long term.

In the first heater 63 with temperature detecting device according to the present embodiment, on the other hand, the first laminated heater 61 includes a heater metallic section 61*p* in which, of the heater element 61*d*, the first insulating resin film 61*c*, the second insulating resin film 61*e*, the first metal sheet 61*b*, and the second metal sheet 61*f*, only the first metal sheet 61*b* and the second metal sheet 61*f* are arranged in a lamination direction of the first heater 63 (in a vertical direction in FIG. 9), as shown in FIG. 9. To this heater metallic section 61*p*, the temperature sensor 64 is fixedly secured with the flat rivet 69. In other words, the temperature sensor 64 is fixed to the heater metallic section 61*p* with the flat rivet 69, without the heater element 61*d*, first insulating resin film 61*c* and second insulating resin film 61*e*.

Specifically, the heater metallic section 61*p* is formed with a through hole 61*q* through which a shaft 69*b* of the flat rivet 69 is inserted. The temperature sensor 64 is also formed with a through hole 64*h* through which a shaft 69*b* of the flat rivet 69 is inserted. Using the through holes 61*q* and 64*h*, the temperature sensor 64 and the heater metallic section 61*p* are fastened with the flat rivet 69 in the following manner.

The temperature sensor 64 is first disposed on the outer surface 61*m* of the first metal sheet 61*b* so that the through hole 61*q* of the heater metallic section 61*p* and the through hole 64*h* of the temperature sensor 64 are coaxially aligned with each other. In this state, the shaft 69*b* of the flat rivet 69 is inserted (from below in FIG. 9) into the through hole 61*q* of the heater metallic section 61*p* and the through hole 64*h* of the temperature sensor 64. Successively, an end of the shaft 69*b* of the flat rivet 69 is plastically deformed by fixing (forming a plastic-deformed end 69*d*), thereby holding the temperature sensor 64 and the heater metallic section 61*p* in pressure contact with each other in an axial direction of the flat rivet 69 (in the vertical direction in FIG. 9). Thus, the temperature sensor 64 is fastened to the heater metallic section 61*p* with the flat rivet 69 and hence fixed in contact with the outer surface 61*m* of the first metal sheet 61*b*.

When the temperature sensor 64 and the heater metallic section 61*p* are fastened to each other without the first and second insulating resin films 61*c* and 61*e*, the first and second insulating resin films 61*c* and 61*e* will not be distorted as above. The heater metallic section 61*p* is extremely rigid as compared with the first and second insulating resin films 61*c* and 61*e* and therefore is unlikely to be distorted by the fastening power of the flat rivet 69. This makes it possible to prevent the generation of a gap between the temperature sensor 64 and the outer surface 61*m* of the first metal sheet 61*b*. Accordingly, the temperature sensor 64 can be fixed to the first metal sheet 61*b* with the temperature measuring portion 64*g* of the temperature sensor 64 held in contact with the outer surface 61*m* of the first metal sheet 61*b*.

Further, the fastening power of the flat rivet 69 will not cause the first and second insulating resin films 61*c* and 61*e* to creep and hence the heater metallic section 61*p* is unlikely to creep. The temperature measuring portion 64*g* of the temperature sensor 64 can therefore be held in contact with the first metal sheet 61*b* over a long period of time.

The flat rivet 69 plastically deformed in itself (forming the plastic deformed portion 69*d*) fastens the temperature sensor 64 to the heater metallic section 61*p*. Accordingly, a decrease in fastening power over time is extremely small.

Furthermore, the temperature sensor 64 is fastened to the heater metallic section 61*p* with the flat rivet 69 inserted in the fastened part 64*d* made of metal (see FIG. 9). This fastened part 64*d* has the strength enough to keep its shape against the fastening power of the flat rivet 69 and thus can prevent the temperature sensor 64 from becoming deformed or distorted by the fastening power of the flat rivet 69. The fastened part 64*d* can also prevent the temperature sensor 64 from creeping after fastening with the flat rivet 69.

As a result, the temperature measuring portion 64*g* of the temperature sensor 64 can be stably held in contact with the first metal sheet 61*b* over long periods. In the first heater 63 with temperature detecting device, consequently, the temperature sensor 64 can accurately detect the temperature of the first laminated sheet heater 61 over long periods.

In the present embodiment, furthermore, the temperature sensor 64 is placed in a position surrounded (on three sides, in the present embodiment) by the heater element 61*d* in plan view of the first laminated heater 61 as shown in FIG. 7. The temperature sensor 64 can adequately detect the temperature of the first laminated heater 61.

In the case where the temperature sensor 64 is placed on an end area of the first laminated heater 61 away from the heater element 61*d*, the temperature detected by the temperature sensor 64 will be largely different from (very lower than) the actual temperature of the heater element 61*d*. When the temperature control (ON-OFF control or the like) of the heater is to be executed by use of such temperature sensor 64, the battery pack 50 may not be heated appropriately. As compared with this, the heater 63 with temperature detecting device in the present embodiment can reduce a difference between a detected temperature by the temperature sensor 64 and an actual temperature of the heater element 61*d*, so that the accuracy of temperature control of the first laminated heater 61 can be enhanced.

The first sheet 62 is an urethane foam sheet, which is placed between the first laminated heater 61 and the first holder 65 as shown in FIG. 6. This first sheet 62 is elastically deformable in a direction of its thickness (in a vertical direction in FIG. 6).

The first holder 65 is formed in recessed rectangular shape, including a holding part 65*c* internally holding the first laminated heater 61 and a rectangular annular flange 65*b* surrounding an open end of the holding part 65*c*. This flange 65*b* is formed with a plurality of through holes 65*d* each allowing a threaded portion 12*b* of a mounting bolt 12 to pass through.

The bottom wall 34*b* of the second housing member 30 is formed with threaded holes 34*c* in positions corresponding to the through holes 65*d* of the first heater unit 60. In the present embodiment, the threaded portion 12*b* of the mounting bolt 12 is inserted through the through hole 65*d* of the flange 65*b* and threadedly engaged in the threaded hole 34*c* of the bottom wall 34*b* of the second housing member 30, thereby detachably fastening the first heater unit 60 to an outer surface 34*f* of the bottom wall 34*b* of the second housing member 30.

As above, the first heater unit 60 is detachably provided outside the housing case 40 (i.e., on the outer surface 34*f* of the bottom 34*b* of the second housing member 30). Accordingly, the first heater unit 60 can easily be detached from and attached to the housing case 40 of the battery pack 50. This configuration can improve workability in maintenance, replacement, or the like for the first heater 63 with temperature detecting device.

Meanwhile, the heated surface 35*b* of the battery pack 50 includes a flat portion 35*c* to be heated (hereinafter, a "heated portion") and a recess 35*d* recessed protruding into the inside of the battery pack 50 (into the space S). When the first heater unit 60 is fixed to the bottom 34*b* of the second housing member 30, the temperature sensor 64 is received in the recess 35*d* of the heated surface 35*b* by bringing the outer surface 61*m* of the first metal sheet 61*b* into contact with the flat heated portion 35*c* of the heated surface 35*b*. Thus, the temperature sensor 64 is placed in a position surrounded by the first laminated heater 61 (the first metal sheet 61*b*) and the recess 35*d* of the heated surface 35*b*. The temperature sensor 64 is unlikely to be cooled by outside air or the like and therefore can detect the temperature of the first laminated heater 61 adequately.

In the present embodiment, part of the bottom 34*b* of the second housing member 30 is shaped by press molding into a recessed form, which serves as the recess 35*d* of the heated surface 35*b*. This makes it possible to increase the strength of the bottom 34*b* of the second housing member 30.

In the present embodiment, additionally, the first sheet 62 is placed between the first laminated heater 61 and the first holder 65 and the first sheet 62 is elastically compressively deformed in the direction of thickness of the first laminated heater 61 (in the vertical direction in FIG. 6). The elastic force of the first sheet 62 caused by elastically compressively deformation brings the outer surface 61*m* of the first metal sheet 61 into close contact with the heated portion 35*c*. As a result, a gap is unlikely to be formed between the outer surface 61*m* of the first metal sheet 61*b* and the heated portion 35*c*. The first laminated heater 61 can heat the battery pack 50 adequately.

In particular, the outer surface of the metal sheet has a smaller variation in temperature distribution than the surface of the insulating resin film. Accordingly, when the outer surface 61*m* of the first metal sheet 61*b* is heated in close contact with the heated portion 35*c*, uneven heating of the heated portion 35*c* can be avoided. It is therefore possible to reduce uneven heating among the secondary batteries 100 forming the battery pack 50, thereby reducing variations in temperature among the secondary batteries 100.

The heat of the first laminated heater 61 can be transferred to the battery pack 50 adequately, so that the first laminated heater 61 can be prevented from excessively locally rising in temperature.

In the first heater 63, as shown in FIG. 9, the head 69*c* of the flat rivet 69 protrudes by a distance D1 from the outer surface 61*n* of the second metal sheet 61*f* (the outer surface of the first laminated heater 61). As shown in FIG. 6, however, the first sheet 62 made of urethane foam, placed on the outer surface 61*n* of the second metal sheet 61*f*, is deformed to absorb the protruding distance D1 of the head 69*c* of the flat rivet 69. Thus, the first sheet 62 adequately presses the outer surface 61*n* of the second metal sheet 61*f* to hold the outer surface 61*m* of the first metal sheet 61*b* in close contact with the heated portion 35*c*.

The second heater unit 70 includes, as shown by reference codes in parentheses in FIG. 6, a second heater 73 with temperature detecting device (hereinafter, simply referred to as a "second heater"), a second sheet 72, a second holder 75 that holds them, and a heat insulating member 78. As with the first heater unit 60, the second heater unit 70 is constituted of the second heater 73, the second sheet 72, the second holder 75, and the heat insulating member 78 which are integrally bonded to one another.

The second heater 73 includes a first laminated sheet heater 71 and a temperature sensor 64 (corresponding to a temperature detecting device).

The second laminated heater 71 is a sheet heater of a laminated structure, as shown by reference codes in parentheses in FIG. 8, including a first insulating resin film 71*c*, a second insulating resin film 71*e*, a heater element 71*d* placed between an inner surface 71*g* of the first insulating resin film 71*c* and an inner surface of 71*h* of the second insulating resin film 71*e*, a first metal sheet 71*b* laminated on an outer surface 71*j* of the first insulating resin film 71*c* opposite the heater element 71*d*, and a second metal sheet 71*f* laminated on an outer surface 71*k* of the second insulating resin film 71*e* opposite the heater element 71*d*.

In the second heater 73, as shown by reference codes in parentheses in FIG. 9, as with the first heater 63, the second laminated heater 71 includes a heater metallic section 71*p* in which, of the heater element 71*d*, the first insulating resin film 71*c*, the second insulating resin film 71*e*, the second metal sheet 71*b*, and the second metal sheet 71*f*, only the first metal sheet 71*b* and the second metal sheet 71*f* are arranged in a lamination direction of the second heater 73 (in the vertical direction in FIG. 9). To this heater metallic section 71*p*, the temperature sensor 64 is fixedly secured with the flat rivet 69. In other words, the temperature sensor 64 is fixed to the heater metallic section 71*p* with the flat rivet 69 without the heater element 71*d*, first insulating resin film 71*c*, and second insulating resin film 71*e*.

Accordingly, the fastening power of the flat rivet 69 will not cause the first and second insulating resin films 71*c* and 71*e* to be distorted and the heater metallic section 71*p* is unlikely to be distorted. This makes it possible to prevent the generation of a gap between the temperature sensor 64 and the outer surface 71*m* of the first metal sheet 71*b*. Accordingly, the temperature sensor 64 can be fixed to the first metal sheet 71*b* with the temperature measuring portion 64*g* of the temperature sensor 64 held in contact with the outer surface 71*m* of the first metal sheet 71*b*. Further, the fastening power of the flat rivet 69 will not cause the first and second insulating resin films 71*c* and 71*e* to creep and hence the heater metallic section 71*p* is unlikely to creep. Thus, the temperature measuring portion 64*g* of the temperature sensor 64 can be held in contact with the first metal sheet 71*b* over long periods.

As in the first heater 63 with temperature detecting device, the temperature sensor 64 is fastened to the heater metallic section 71*p* with the rivet 69 inserted in the fastened part 74*d* made of metal (see FIG. 9). As a result, the temperature measuring portion 64*g* of the temperature sensor 64 can be stably held in contact with the first metal sheet 71*b* over a long period of time. In the second heater 73, consequently, the temperature sensor 64 can accurately detect the temperature of the second laminated heater 71 over long periods.

Further, the temperature sensor 64 is placed in a position surrounded (on three sides, in the present embodiment) by the heater element 71*d* in plan view of the second laminated heater 71 as shown in FIG. 7. The temperature sensor 64 can adequately detect the temperature of the second laminated heater 71.

As shown by the reference codes in parentheses in FIG. 6, the second heater unit 70 is similarly detachably provided outside the housing case 40 (i.e., on the outer surface 34*f* of the bottom 34*b* of the second housing member 30). Accordingly, the second heater unit 70 can easily be detached from and attached to the housing case 40 of the battery pack 50. This configuration can improve workability in maintenance, replacement, or the like for the second heater 73.

Furthermore, when the second heater unit 70 is fixed to the bottom 34*b* of the second housing member 30 as shown by the reference codes in parentheses in FIG. 6, the temperature sensor 64 is received in the recess 35*d* of the heated surface 35*b* by bringing the outer surface 71*m* of the first metal sheet 71*b* into contact with the heated portion 35*c* of the heated surface 35*b*. Thus, the temperature sensor 64 is placed in a position surrounded by the second laminated heater 71 (the first metal sheet 71*b*) and the recess 35*d* of the heated surface 35*b*. The temperature sensor 64 is unlikely to be cooled by outside air or the like and therefore can detect the temperature of the second laminated heater 71 adequately.

The second sheet 72 is placed between the second laminated heater 71 and the second holder 75 and the second sheet 72 is elastically compressively deformed in the direction of thickness of the second laminated heater 71 (in the vertical direction in FIG. 6). The elastic force of the second sheet 72 caused by elastically compressively deformation brings the outer surface 71*m* of the first metal sheet 71*b* into close contact with the heated portion 35*c*. As a result, a gap is unlikely to be formed between the outer surface 71*m* of the first metal sheet 71*b* and the heated portion 35*c*. The second laminated heater 71 can heat the battery pack 50 adequately.

In particular, the outer surface of the metal sheet has a smaller variation in temperature distribution than the surface of the insulating resin film. Accordingly, when the outer surface 71*m* of the first metal sheet 71*b* is heated in close contact with the heated portion 35*c*, uneven heating of the heated portion 35*c* can be reduced. It is therefore possible to reduce uneven heating among the secondary batteries 100 forming the battery pack 50, thereby reducing temperature variations among the secondary batteries 100.

The heat of the second laminated heater 71 can be transferred to the battery pack 50 adequately, so that the second laminated heater 71 can be prevented from excessively locally rising in temperature.

The first and second laminated heaters 61 and 71 are heaters that can be energized or powered by a household AC power source to generate heat. The first heater 61 and the second heater 71 are electrically connected to an alternator plug 15 as shown in FIG. 3. Accordingly, the alternator plug 15 is connected to an outlet of the household AC power source to supply electric power to the first and second laminated heaters 61 and 71, thereby causing them to generate heat.

Here, a heating function of the heater-equipped battery structure 10 will be explained in detail.

In the heater-equipped battery structure 10 of the present embodiment, as mentioned above, the first heater 63 and the second heater 73 are placed on the outer surface 35*b* of the spaced part 35 of the second housing member 30 (the housing case 40) (see FIG. 3). This configuration allows the heat of the first laminated heater 61 and the second laminated heater 71 to be conducted to the spaced part 35, thus heating the air in the space S through the heated spaced part 35. Then, each secondary battery 100 is exposed to the heated air and heated.

According to the above heating manner, it is possible to prevent uneven heating among the secondary batteries 100 of the battery pack 50 and thus reduce variations in temperature among the secondary batteries 100. This makes it possible to reduce variations in output characteristics among the secondary batteries 100. The entire battery pack 50 can therefore produce stable output.

The temperature sensor 64 can accurately detect the temperature of the first laminated heater 61, so that the temperature control of the heater (ON-OFF control and others) can be conducted adequately by use of an output signal from the temperature sensor 64. In case the first laminated heater 61 abnormally rises in temperature due to some failures or malfunctions, for example, the abnormal rise in temperature of the first laminated heater 61 can be detected based on the output signal from the temperature sensor 64 and energization of the first laminated heater 61 is stopped immediately.

The above configuration can prevent the first laminated heater 61 from excessively rising in temperature and hence prevent an excessive temperature rise of each secondary battery 100 constituting the battery pack 50. This heater temperature control can also applied to the second laminated heater 71. In the present embodiment, the space S as well as the spaced part 35 exists between each of the first and second laminated heaters 61 and 71 and each of the secondary batteries 100. Accordingly, each secondary battery 100 can be prevented from excessively rising in temperature.

As shown in FIG. 6, the first heater unit 60 of the present embodiment is provided with the heat insulating member 68 under the lower surface 65*g* of the holder 65 opposite the holding surface 65*f*. Similarly, as shown in FIG. 7, the second heater unit 70 is also provided with the insulating member 78 under the lower surface 75*g* of the holder 75 opposite the holding surface 75*f* holding the second heater 71. Accordingly, the heat of the first and second laminated heaters 61 and 71 are unlikely to escape from the lower surfaces 65*g* and 75*g* of the holders 65 and 75.

Figure 10:
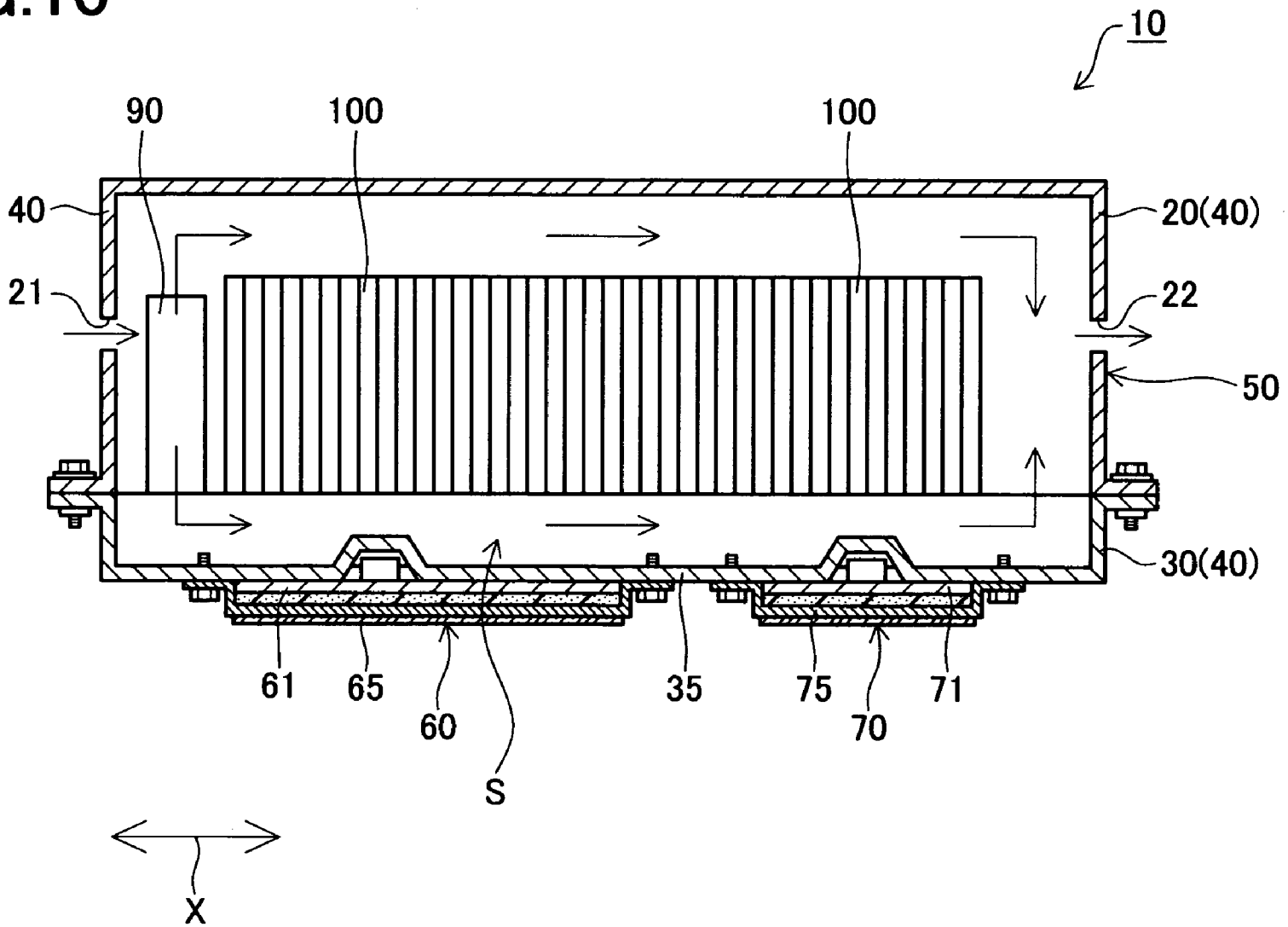
FIG. 10 is an explanatory view to show a cooling function of the battery structure with heater, taken along the line P-P of FIG. 1.

In the heater-equipped battery structure 10 of the present embodiment, as shown in FIG. 3, a cooling device 90 is placed in the housing case 40. If the temperatures of the secondary batteries 100 rise to high temperatures, the cooling device 90 is operated to cool the secondary batteries 100. More specifically, as shown in FIG. 10, upon activation, the cooling device 90 takes in outside air through a first air hole 21 of the first housing member 20, delivers cooled air (outside air) through the inside of the housing case 40 including the space S, and discharges the heat of the secondary batteries 100 out of the structure 10 through a second air hole 22. Thus, each of the secondary batteries 100 can be cooled appropriately. In the present embodiment, particularly, no heater exists between each secondary battery 100 and the air passage (including the space S) and therefore each secondary battery 100 can be cooled efficiently.

<Modified Form>

A modified form is different only in a heater with temperature detecting device from the above embodiment and parts or components other than that heater are identical to those in the above embodiment. The following explanation is made with a focus on the differences from the above embodiment without repeatedly explaining the identical parts or components.

To be specific, as shown in FIG. 9, the above embodiment uses the first laminated heater 61 including the heater metallic section 61*p* in which, of the heater element 61*d*, the first insulating resin film 61*c*, the second insulating resin film 61*e*, the first metal sheet 61*b*, and the second metal sheet 61*f*, only the first and second metal sheets 61*b* and 61*f* are arranged in the lamination direction of the first laminated heater 61 (in the vertical direction in FIG. 9). The temperature sensor 64 is fixedly fastened to the heater metallic section 61*p* of the first laminated heater 61 with the flat rivet 69, constituting the first heater 63 with temperature detecting device.

Figure 11:
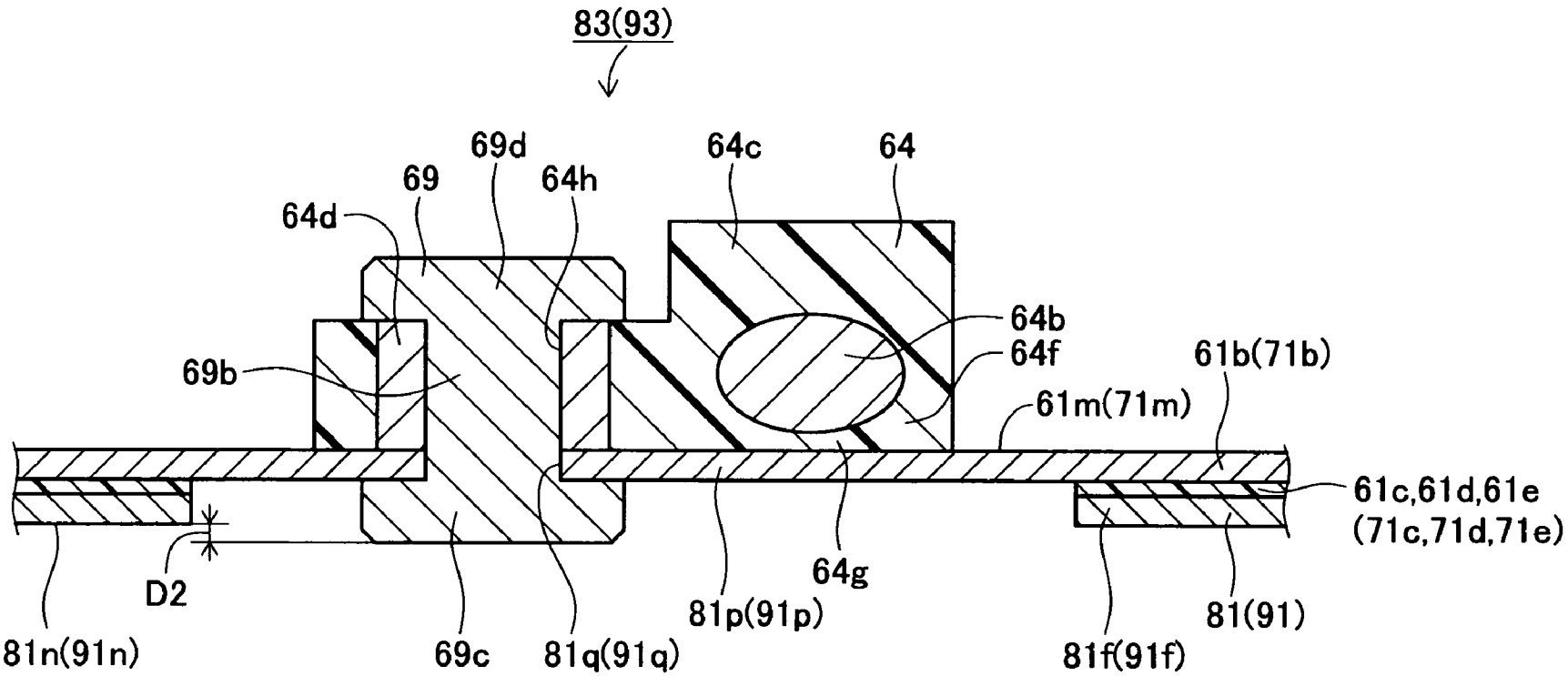
FIG. 11 is a sectional view of a mounting structure of the temperature sensor of the heater with temperature detecting device in a modified form.

On the other hand, the present modified form uses a first laminated heater 81 including a heater metallic section 81*p* in which, of the heater element 61*d*, the first insulating resin film 61*c*, the second insulating resin film 61*e*, the first metal sheet 61*b*, and a second metal sheet 81*f*, only the first metal sheet 61*b* is arranged in a lamination direction of the first laminated heater 81 (in a vertical direction in FIG. 11). A temperature sensor 64 is fastened to the heater metallic section 81*p* of the first laminated heater 81 with the flat rivet 69, constituting a first heater 83 with temperature detecting device.

The first heater 83 of the modified form differs in that the heater metallic section for fastening the temperature sensor 64 includes no second metal sheet from the first heater 63 with temperature detecting device of the above embodiment. According to the first heater 83 of the modified form, the protruding distance of the head of the flat rivet 60 from the outer surface of the second metal sheet can be reduced by an amount corresponding to the thickness of the second metal sheet as compared with that in the first heater 63 of the above embodiment.

As clearly seen from a comparison between FIGS. 9 and 11, specifically, the protruding distance of the head 69*c* of the flat rivet 69 from the outer surface of the second metal sheet can be reduced from D1 (the above embodiment) to D2 (the modified form). This reduction in protruding distance of the head 69*c* of the flat rivet 69 from the outer surface of the second metal sheet allows the first sheet 62 to more suitably press the outer surface 81*n* of the second metal sheet 81*f*, thereby holding the outer surface 61*m* of the first metal sheet 61*b* in close contact with the heated portion 35*c*.

Furthermore, as shown by reference codes in parentheses in FIG. 11, a second heater 93 with temperature detecting device is arranged, as with the first heater 83 with temperature detecting device, such that a heater metallic section 91*p* for fastening the temperature sensor 64 does not include a second metal sheet 91*f*. The protruding distance of the head 69*c* of the flat rivet 69 from the outer surface of the second metal sheet can be reduced by an amount corresponding to the thickness of the second metal sheet.

In the modified form, the flat rivet 69 may be replaced with a rivet having a head thinner than a portion of the first laminated heater 81 in which the heater element 61*d*, first insulating resin film 61*c*, second insulating resin film 61*e*, and second metal sheet 81*f* are laminated. This configuration is more preferable to keep the rivet head from protruding from the outer surface of the second metal sheet. The same applies to the second heater with temperature detecting device.

The present invention is explained referring to the above embodiment and the modified form, but the present invention may be embodied in other specific forms without departing from the essential characteristics thereof.

In the above embodiments, the battery pack 50 including the plurality of secondary batteries 100 (forty batteries in the embodiment) and the housing case 40 housing them is exemplified as a battery structure to be heated. Alternatively, the battery structure may be configured as a cell constituted of a single power generating element accommodated in a battery case or a battery module including a plurality of power generating elements and a battery case having a plurality of compartments individually accommodating the power generating elements. In other words, the cell, the battery module, or others may be configured to be directly heated by a heater.

In the above embodiment, the secondary battery 100 is exemplified as a battery module including the battery case 101 integrally formed with six compartments 124 and the power generating elements individually accommodated in the compartments 124. Alternatively, the secondary battery may be a cell comprising a single power generating element accommodated in a battery case.

In the above embodiment, the secondary battery 100 provided with the resin battery case 101 and others is used. The material of the battery case is not limited to resin and may be selected from metal or other materials. Although the secondary battery in the above embodiment is a nickel-metal hydride storage battery, the present invention can also be applied to the case where the secondary battery is one of other batteries (including a primary battery) such as a lithium ion battery.

In the above embodiments, the temperature sensor 64 is used for the temperature detecting device, which is fastened to the heater metallic section 61*p* or others with the flat rivet 69 and fixed to the outer surface 61*m*, 71*m* of the first metal sheet 61*b*, 71*b* of the first laminated heater 61, 71. However, another temperature detecting device such as a thermal fuse and a PTC thermistor may be used instead of the temperature sensor. Such device may be fastened similarly to the heater metallic section 61*p* or others with the flat rivet 69 and fixed to the outer surface 61*m*, 71*m* of the first metal sheet 61*b*, 71*b* of the first laminated heater 61, 71.

In the above embodiments, the mechanical fastening device for fastening the temperature sensor 64 to the heater metallic section 61*p* or others is the flat rivet 69, but may be another form such as a blind rivet, a metal a metal eyelet, a bolt, and a nut.

In the above embodiments, the outer surface 61*m*, 71*m* of the first metal sheet 61*b*, 71*b* is held in contact with the heated portion 35*c* of the heated surface 35*b*. An alternative is to turn the first heater 63 upside down to bring the outer surface 61*n* (71*n*, 81*n*, 91*n*) of the second metal sheet 61*f* (71*f*, 81*f*, 91*f*) into contact with the heated portion of the heated surface 35*b*.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A heater with temperature detecting device, comprising:

a laminated sheet heater including:

a first insulating resin film;

a second insulating resin film;

a heater element made of metal foil in one of a strip-shaped predetermined pattern and a sheet shape, the heater element being placed between the first insulating resin film and the second insulating resin film, and a first metal sheet laminated on a surface of the first insulating resin film opposite the heater element and a second metal sheet laminated on a surface of the second insulating resin film opposite the heater element, the first metal sheet having a planar outer surface that is opposed to a surface laminated on the surface of the first insulating resin film; and a temperature detecting device including a temperature measuring portion that includes a thermistor, the temperature detecting device having a through hole in a fastened portion that does not include the temperature measuring portion, wherein the laminated sheet heater includes a heater metallic section in which, of the first insulating resin film, the second insulating resin film, the heater element, the first metal sheet, and the second metal sheet, any one of only the first metal sheet and only a combination of the first metal sheet and the second metal sheet is arranged in a lamination layering direction of the laminated sheet heater, and the temperature detecting device is fastened to the planer outer surface of the first metal sheet at the heater metallic section of the laminated sheet heater with mechanical fastening means so that the temperature detecting device is fixed to the planar outer surface of the first metal sheet with at least the temperature measuring portion of the temperature detecting device held in contact with the planer outer surface of the first metal sheet, wherein the mechanical fastening means is a metal fixing member for fastening the temperature detecting device to the heater metallic section, and the temperature detecting device is placed on a surface of a first metal sheet so that an axis of a through hole of the heater metallic section coincides with an axis of a through hole of the temperature detecting device, and the metal fixing member is inserted through the two through holes to fasten the temperature detecting device and the heather metallic section.

2. The heater with temperature detecting device according to claim 1, wherein the laminated sheet heater includes both the first metal sheet and the second metal sheet, and the heater metallic section includes, of the first metal sheet and the second metal sheet, only the first metal sheet in the lamination layering direction of the laminated sheet heater.

3. The heater with temperature detecting device according to claim 1, wherein the fastened portion of the temperature detecting device is secured to the heater metallic section with the mechanical fastening means, the fastened portion of the temperature detecting device has sufficient rigidity so as to not be deformed by the fastening power of the mechanical fastening means.

4. The heater with temperature detecting device according to claim 1, wherein the temperature detecting device is placed in a position surrounded on three sides by the heater element in plan view of the laminated sheet heater.

5. A battery structure with heater, comprising:

a battery structure containing a power generating element and having a surface to be heated; and a heater fixed to the battery structure and arranged to heat the surface to be heated to thereby heat the power generating element;

the heater being a heater with temperature detecting device, comprising:

a laminated sheet heater including:

a first insulating resin film;

a second insulating resin film;

a heater element made of metal foil in one of a strip-shaped predetermined pattern and a sheet shape, the heater element being placed between the first insulating resin film and the second insulating resin film, and at least one of a first metal sheet laminated on a surface of the first insulating resin film opposite the heater element and a combination of the first metal sheet and a second metal sheet laminated on a surface of the second insulating resin film opposite the heater element; and a temperature detecting device including a temperature measuring portion, wherein;

the laminated sheet heater includes a heater metallic section in which, of the first insulating resin film, the second insulating resin film, the heater element, the first metal sheet, and the second metal sheet, any one of only the first metal sheet and only a combination of the first metal sheet and the second metal sheet is arranged in a lamination direction of the laminated sheet heater, and the temperature detecting device includes a thermistor in the temperature measuring portion and is fastened to the heater metallic section of the laminated sheet heater with mechanical fastening means so that the temperature detecting device is fixed to the outer surface of the first metal sheet with at least the temperature measuring portion of the temperature detecting device held in contact with the planar outer surface of the first metal sheet, the surface of the battery structure to be heated includes:

a flat portion to be heated; and a recessed portion protruding into inside of the battery structure;

the heater with temperature detecting device is fixed to an outer surface of the battery structure so that the temperature detecting device is received in the recessed portion of the surface to be heated and the outer surface of the first metal sheet is held in contact with the surface to be heated.

6. The battery structure according to claim 5, wherein the mechanical fastening means is a metal fixing member for fastening the temperature detecting device to the heater metallic section.

7. The battery structure according to claim 5, wherein the laminated sheet heater includes both the first metal sheet and the second metal sheet, and the heater metallic section includes, of the first metal sheet and the second metal sheet, only the first metal sheet in the lamination layering direction of the laminated sheet heater.

8. The battery structure according to claim 5, wherein the fastened portion of the temperature detecting device is secured to the heater metallic section with the mechanical fastening means, the fastened portion of the temperature detecting device has sufficient rigidity so as to not be deformed by the fastening power of the mechanical fastening means.

9. The battery structure according to claim 5, wherein the temperature detecting device is placed in a position surrounded on three sides by the heater element in plan view of the laminated sheet heater.

* * * * *